United States Patent [19]

Nelson

[11] 4,304,661

[45] Dec. 8, 1981

[54] MACHINES FOR CONCENTRATING ORE

[76] Inventor: George S. Nelson, 1330 Yale Ave., Salt Lake City, Utah 84105

[21] Appl. No.: 128,737

[22] Filed: Mar. 10, 1980

[51] Int. Cl.[3] ..... B07B 9/00

[52] U.S. Cl. ..... 209/35; 209/146; 209/477; 209/499

[58] Field of Search ..... 209/32–35, 209/498, 499, 245, 254, 244, 136, 137, 920, 921, 911, 471, 479, 502, 133–135, 477, 146; 198/608, 758, 771; 222/196

[56] References Cited

U.S. PATENT DOCUMENTS

| | | | |
|---|---|---|---|
| 269,848 | 1/1883 | Granger | 209/471 |
| 447,027 | 2/1891 | Hallowell | 209/137 X |
| 626,539 | 6/1899 | Hathorn | 209/921 X |
| 855,745 | 6/1907 | Argall | 414/302 X |
| 1,053,855 | 2/1913 | Nicholas | 209/479 X |
| 1,211,495 | 1/1917 | Shore | 209/471 |
| 1,341,978 | 6/1920 | Gearing | 209/911 X |
| 1,820,239 | 8/1931 | Menz | 209/365 A X |
| 1,923,951 | 8/1933 | Peale | 209/502 X |
| 1,998,433 | 3/1935 | Nelson | 209/44 |
| 4,003,831 | 1/1977 | Tishkov | 209/394 X |

FOREIGN PATENT DOCUMENTS

| | | | |
|---|---|---|---|
| 490696 | 1/1919 | France | 209/137 |

*Primary Examiner*—Robert Halper

[57] ABSTRACT

The present invention discloses a novel machine that, by a dry process, will segregate granules of different specific gravities. The machine first segregates the granules as to size, regardless of their specific gravities and regardless of the multiplicity of the sizes (within limits set by the machine). In the next step the machine feeds individual granules side by side ranging progressively from fine to more coarse into a stream of air that ranges in carrying power from low to high in a sequence corresponding to the increasing sizes of the granules that fall through it. The carrying power of the air stream is regulated to convey granules having the same specific gravity to the same container, regardless of the sizes of the granules. Granules of different specific gravities will be deposited in different containers. Thus gold will be segregated from silver, and silver from copper etc. by the present invention.

The invention is more fully described in the preceding specification.

3 Claims, 1 Drawing Figure

MACHINES FOR CONCENTRATING ORE

In the Machine described in my U.S. Pat. No. 1,995,433 it was found that when granules of several sizes were fed simultaneously into hopper 5, that some of the fine granules of waste fell on the leeward side of larger granules and being thus sheltered from the air stream they fell in the same location as larger granules of waste and finer granules of metal. This resulted in imperfect separation of metals from waste.

The purposes of this improvement are (1) to eliminate said defect, (2) to simplify the machine and (3) to not only separate metals from waste but to separate metals of different specific gravities from one another.

These purposes are accomplished by the improvements described below.

In the drawings similar numerals refer to similar parts throughout the several views.

Figure 1:
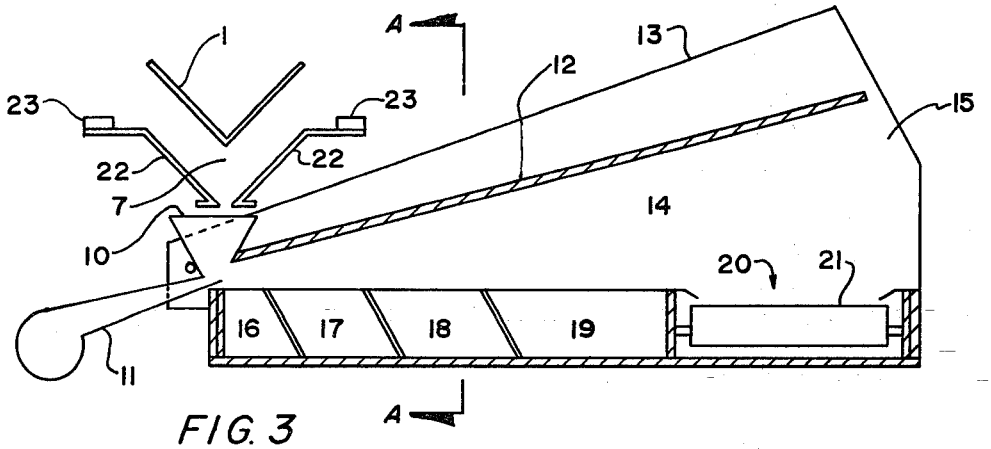
FIG. 1 is a longitudinal section through the machine.
Figure 3:
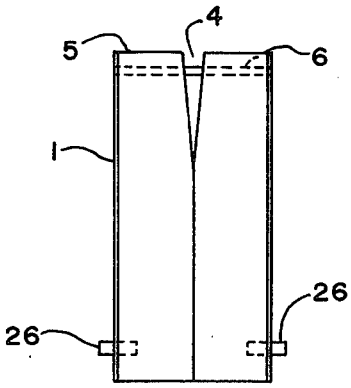
FIG. 3 shows a top view of the jig chute and FIG. 4 shows a top view of the feeder chute only.
Figure 2:
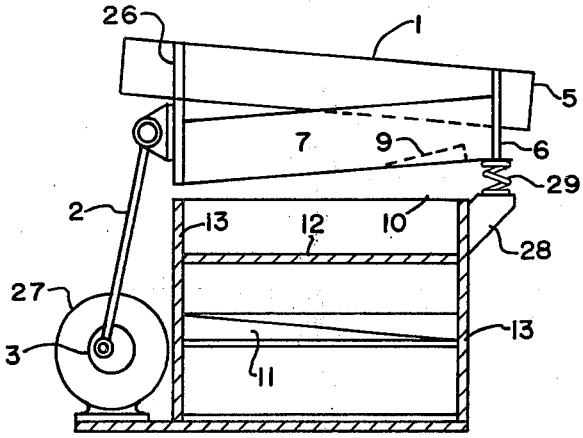
FIG. 2 shows section A—A through the machine.
Figure 4:
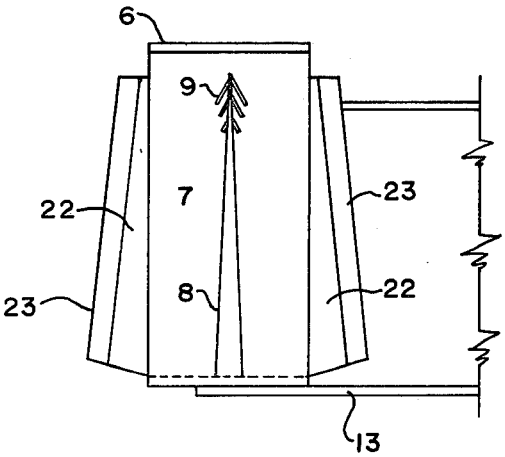

The machine functions substantially as follows: Granules, such as crushed ore, are fed to the upper end of the inclined jig-chute 1 which is preferably caused to vibrate by an eccentric 3 through connecting rod 2 which connects, at its upper end, to frame 26 which joins chutes 1 and 7. This action will cause the finer granules to settle to the bottoms of the chutes and the coarser granules to arrange themselves in upper layers according to their respective sizes. The lower end of jig-chute 1 is preferably equiped with a V shaped aperture 4 which will allow the desired sizes of granules to drop freely to the bottom of the upper end of feeder chute 7. Undesired coarse granules will be rejected at edge 5 and can be sent for additional milling. Various sizes of granules that pass through aperture 4 will be segmented as to size preferably by raised guides 9 attached to feeder chute 7. Bracket 28 and spring 29 support one end of chutes 1 and 7.

Jig-chute 1 and feeder chute 7 are preferably connected by end piece 6 and frame 26. The bottom of feeder chute 7 is provided with a V shaped aperture 8 which ranges in width from substantially zero at the top end of the chute to a width equal to that of the largest granule to be processed at the lower end. This will cause the granules to fall through hopper 10 single file at spaced intervals, and in a single plane lying at right angles to the air jet direction. Each granule will enter the air stream escaping from nozzle 11 alone without interference from any other granule. Granules of the same size, regardless of their specific gravities, will fall separately into the air stream in the same line as determined by the width of aperture 8 where the granule is allowed to fall through.

The horizontal distance any granule will travel in the air stream is determined directly by the square of the air stream velocity and the depth of the stream through which it drops, and inversely by the size of the granule and its specific gravity. The aperture in the elongated nozzle 11 is therefor graduated from a small depth on the end where the fine granules enter the air stream to progressively greater depths where progressively larger granules enter the air stream. The depth of the nozzle aperture is preferably made adjustable at each end to facilitate the regulation of the depth of the air stream as required for the conveyance of both fine and coarse granules, having the same specific gravity, to the same container. This is preferably accomplished by bolt 25 and nut 24 welded to 11.

By properly relating the opening in nozzle 11 to the V shaped aperture 8, and by properly spacing receptacles 16, 17, 18, 19 and waste disposal receptacle 20, the granules will be segregated according to their specific gravities, regardless of their sizes. Receptacle 20 is preferably equipped with a conveyor belt 21 whereby waste is carried away. Any number of receptacles may be installed to collect granules of different specific gravities.

The air velocity in tunnel 14 is preferably controlled, as it flows through its passage, by an adjustable top cover 12. The air tunnel is preferably protected from ouside influences by sides 13. The air exhausts from end 15. Air is forced through nozzle 11 by blower 27.

The tendency of some granules to clog aperture 8 is nullified preferably by attaching rigid flanges 22, preferably weighted at their outer edges with weights 23, to the upper edges of feeder chute 7 whereby parts 7 and 22 will be caused to rotate slightly around their joint thereby causing aperture 8 to alternately expand and contract at each vibration.

It is not intended to limit this invention to the concentration of ore. Obviously the mechanism used in chutes 1 and 7 can be used effectively for fine grading of aggregates for use in concrete mixtures. When used for this purpose chutes 1 and 7 are preferably joined end to end to be continuous in one line, in which case parts 4, 5, 6 and 9 will be eliminated.

Having thus described my invention what I now claim as new and desire to secure by Letters Patent of the United States is as follows:

1. A machine comprising an inclined jig chute contiguous with an inclined feeder chute, said feeder chute having a V shaped aperture in its base, means whereby said chutes are vibrated thereby causing granules fed to them to arrange themselves in a series of layers according to size, means whereby granules that fall from the V shaped aperture in the feeder chute are directed to an air stream moving transverse to the plane in which the granules fall from said aperture, a nozzle having a truncated V shaped orifice the shallow end of which orifice is disposed directly below the narrow end of the feeder chute aperture and the deeper end of which is disposed directly below the wider end of said aperture whereby an airstream is directed transverse to the plane in which the granules fall through said air stream, a blower whereby an air stream is forced through the nozzle, a plurality of receptacles disposed below the air stream starting from a line immediately below the face of the orifice of the nozzle.

2. A machine comprising a jig-chute contiguous with a feeder-chute, said feeder-chute having a V shaped aperture in its base, means whereby said chutes are vibrated, means whereby granules that fall from the V shaped aperture are directed to an air stream, an air nozzle having a truncated V shaped orifice disposed below, slightly behind, and substantially parallel to the plane in which the granules fall, whereby the air stream is directed to traverse said plane, said orifice being so related to the granules that cross it that the smaller granules will fall through the shallower portions of the air stream and progressively larger granules will fall through progressively deeper portions of the air stream, an air tunnel having sides and a top whereby the air stream is protected from outside influences, and a bottom to the air tunnel comprising a plurality of receptacles, the first one of which is disposed below and in close proximity to the nozzle orifice.

3. The same as claim 2 except delete the word "truncated" from line five of the claim.

* * * * *